United States Patent [19]

Yokoyama et al.

[11] 3,977,604

[45] Aug. 31, 1976

[54] FUEL INJECTION NOZZLE ASSEMBLY

[76] Inventors: Taro Yokoyama, 2-20, 5-chome, Tokowadaira, Matsudo, Chiba; Osamu Akibayashi, 14-7, 2-chome, Moto-Ookubo, Narashino, Chiba, both of Japan

[22] Filed: June 25, 1975

[21] Appl. No.: 590,026

[30] Foreign Application Priority Data

July 3, 1974 Japan ..... 49-76069

[52] U.S. Cl. ..... 239/102; 239/432; 239/433

[51] Int. Cl.[2] ..... B05B 17/06

[58] Field of Search ..... 239/428, 102, 432, 433; 123/141, 119 E, 25 A, 1 A, 33 D

[56] References Cited

UNITED STATES PATENTS

| | | | |
|---|---|---|---|
| 505,931 | 10/1893 | Thurman | 239/428 |
| 735,287 | 8/1903 | Neuendorff | 239/428 X |
| 3,173,612 | 3/1965 | Boucher | 239/102 X |
| 3,558,056 | 1/1971 | Hughes | 239/102 |
| 3,845,901 | 11/1974 | Voloshin | 239/102 |

*Primary Examiner*—John J. Love

*Attorney, Agent, or Firm*—George B. Oujevolk

[57] ABSTRACT

A pear or egg-shaped nozzle housing having a main jet nozzle at the tapered end, and several auxiliary nozzles at the other end of the housing. Inside the housing are two ultrasonic vibrators, one, a disc vibrator facing the auxiliary nozzles thus forming a hemisphere with the other housing end and the other a ring vibrator at the throat of the main jet nozzle.

8 Claims, 7 Drawing Figures

FUEL INJECTION NOZZLE ASSEMBLY

BACKGROUND OF THE INVENTION

The present invention relates generally to a fuel injection assembly for burners, external- and internal-combustion engines and more particularly to a fuel injection nozzle assembly which consists of two ultrasonic atomizers and several auxiliary nozzles for the injection of water and a plurality of fuels and oxidizers.

BRIEF REVIEW OF THE PROBLEM AND PRIOR ART

The customary use of a fuel injection nozzle for delivering liquid fuel to burners, external- and internal-combustion engines involves the problem of insufficient atomizing for a wide range of operations, for atomizing is a function of fuel pressure, the size of the nozzle aperture and the speed of the air flow. This is especially a problem for a variable-speed unit such as an automobile engine.

Other prior fuel injection nozzle designs have been incapable of delivering move than one kind of fuel with a single nozzle. High thermal efficiency and non-noxious combustion appear to be the two most urgent problems for engines. In order to attain a complete and well controlled combustion which provides high thermal efficiency as well as a reduced amount of harmful bi-products of oxidation, it is advantageous to use a mixture of several kinds of fuels and oxidizers rather than relying on only one combination of fuel and oxidizer. The ratio of the mixture should be changed instantaneously in accordance with the demands of the engine in operation.

OBJECTS OF THE INVENTION

Thus it is an object of the present invention to provide an improved fuel delivery system for engines, which provides more complete combustion of fuel thus providing higher thermal efficiency and a reduced amount of toxic bi-products caused by incomplete combustion, such as carbon monoxide and residual hydrocarbons.

Another object of the invention is to provide a novel and improved fuel injection nozzle arrangement which enables the controlled combustion of fuel by means of water-injection, thus reducing the formation of various oxides of nitrogen without sacrificing the thermal efficiency.

A further object of the invention is to provide an improved fuel injection nozzle arrangement which is capable of injecting a mixture of several kinds of oxidizers and fuels with variable ratios in accordance with the changing operational demands of an engine.

A still further object of the invention is to provide an improved fuel injection nozzle arrangement which has ultrasonic atomizers to provide complete atomizing constantly under any operational conditions of an engine.

SUMMARY OF THE INVENTION

Generally speaking, the present invention contemplates a pear or egg-shaped nozzle housing having a main jet nozzle at the tapered end of the housing and several auxiliary nozzles at the other end of the housing. Inside the housing are two ultrasonic vibrators, one, a disc vibrator facing the auxiliary nozzles thus forming a hemisphere with the other housing end and a ring vibrator at the throat of the jet nozzle.

The invention as well as other objects and advantages thereof will become more readily apparent from the following detailed description and the accompanying drawings, in which.

Figure 6:
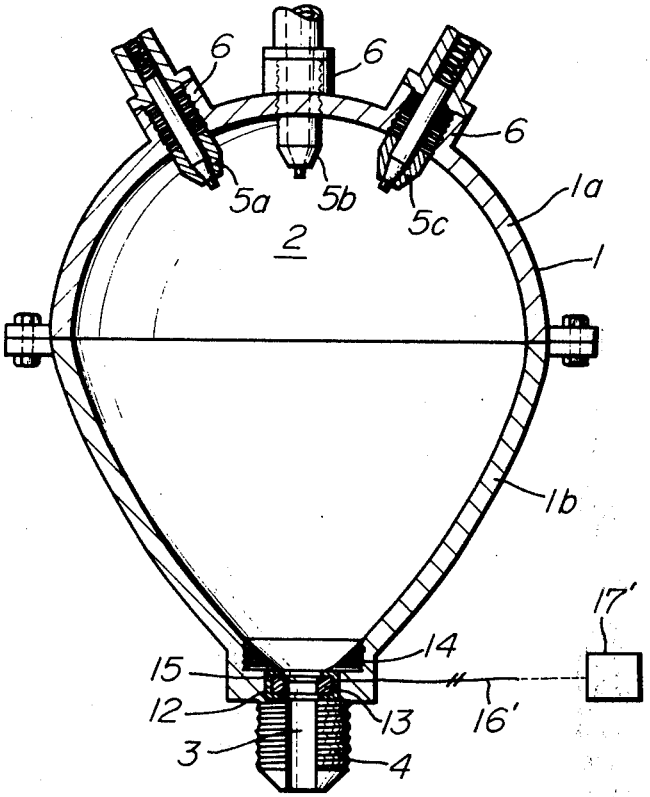
Figure 7:
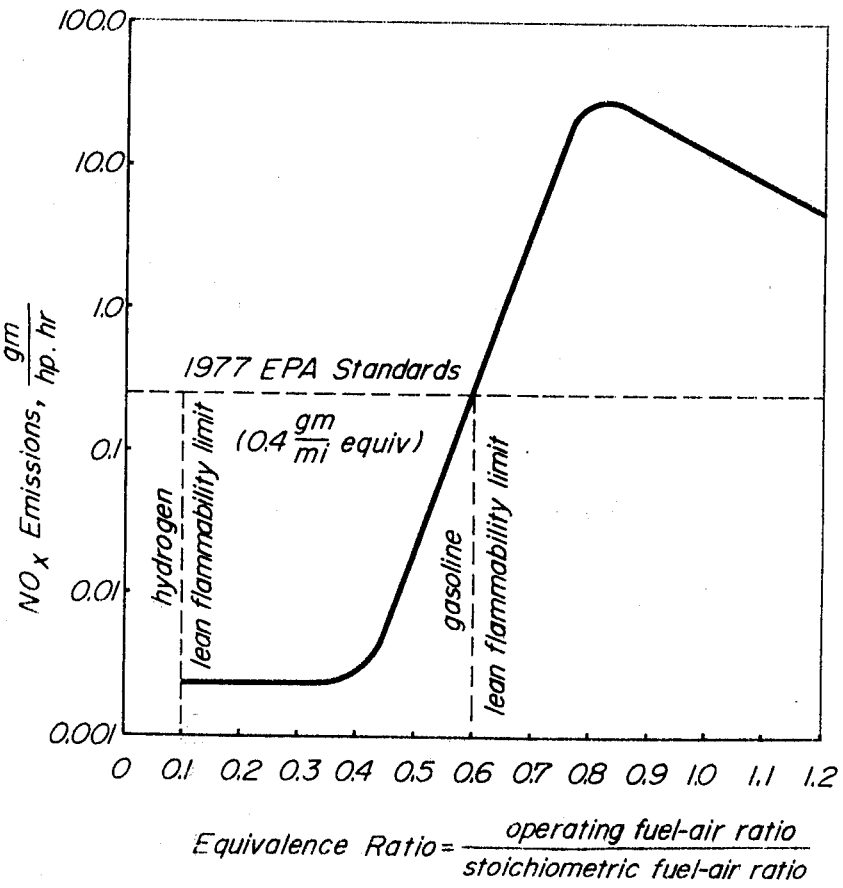

FIG. 6 provides a vertical sectional view of the fuel injection nozzle arrangement without a disc ultrasonic vibratory and one auxiliary nozzle used for air injection only; and, FIG. 7 graphically illustrates the effect of the addition of a small amount of hydrogen into gasoline in a conventional piston engine.

DETAILED DESCRIPTION

Figure 1:
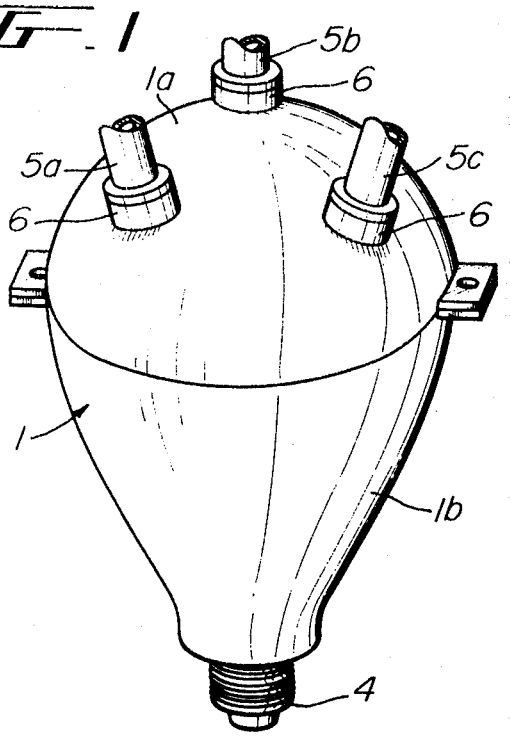
FIG. 1 shows a front elevation of the fuel injection nozzle arrangement herein contemplated.
Figure 2:
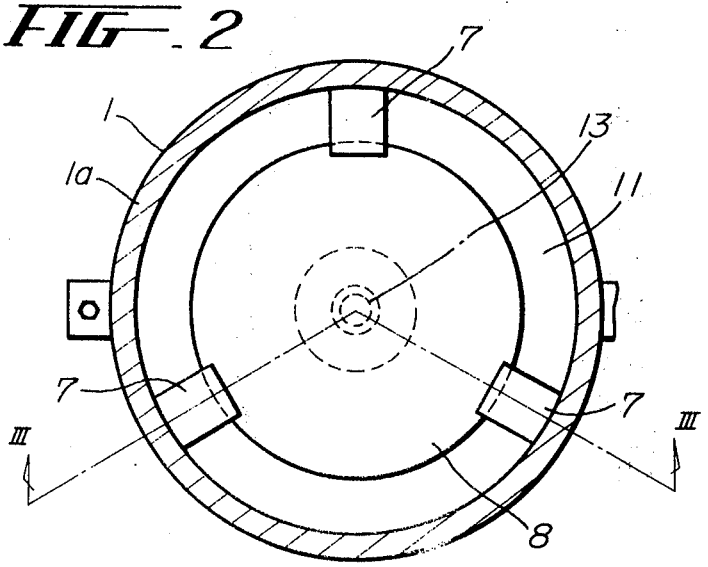
FIG. 2 is a cross-sectional view of the fuel injection nozzle arrangement on the line II—II′ of FIG. 3.
Figure 3:
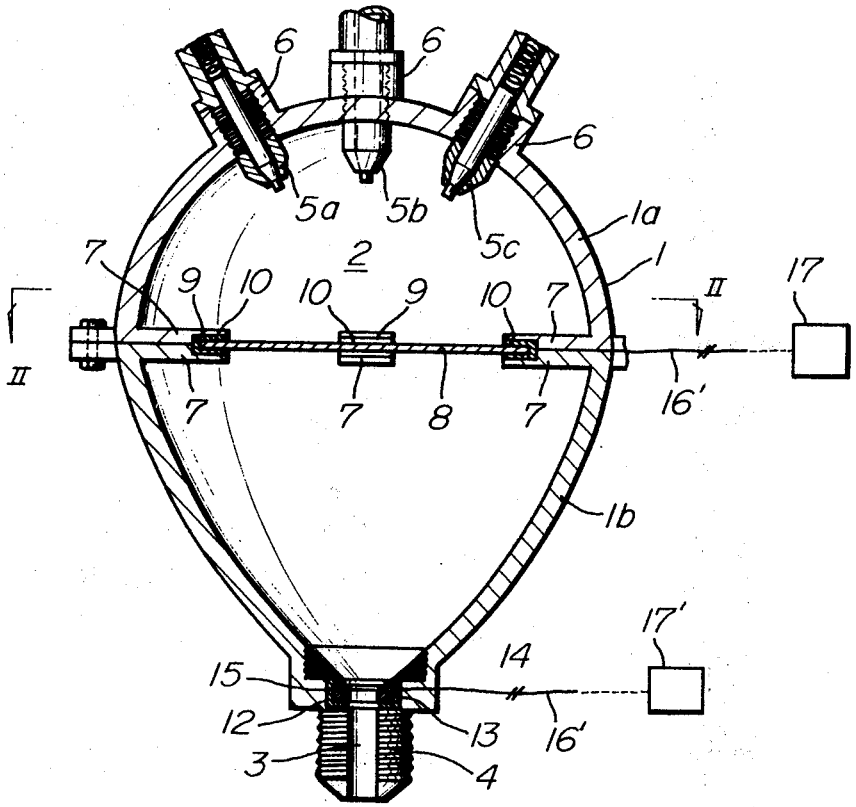
FIG. 3 is a vertical sectional view of the fuel injection nozzle arrangement on line III—III′ of FIG. 2.
Figure 4:
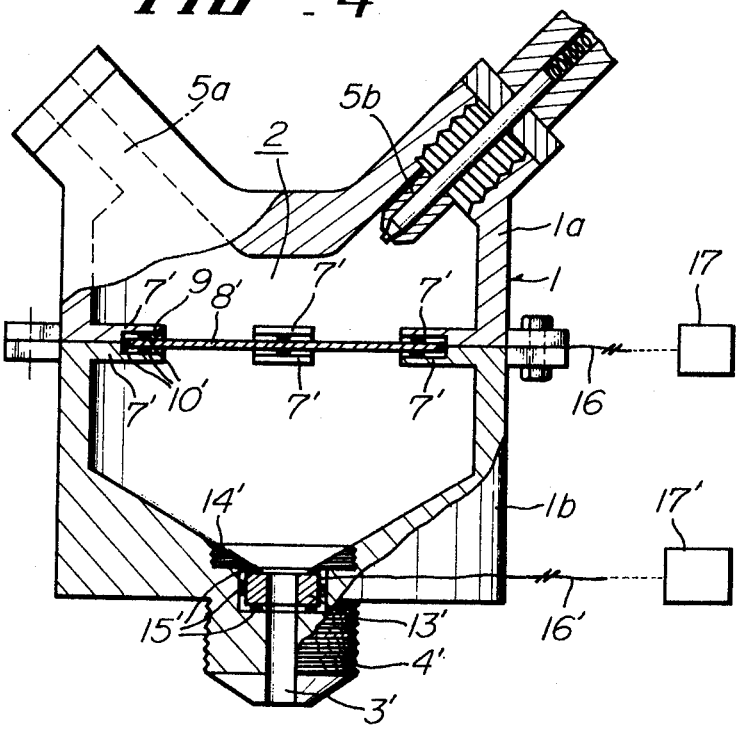
FIG. 4 is a vertical sectional view of the fuel injection nozzle arrangement with two auxiliary nozzles.
Figure 5:
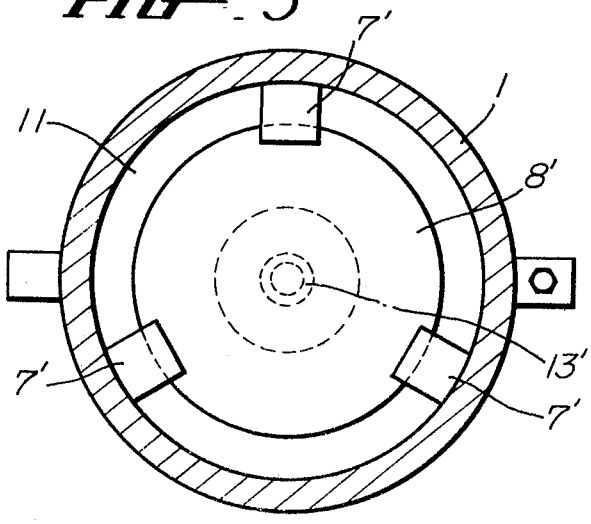
FIG. 5 is a horizontal sectional view of the fuel injection nozzle arrangement with two auxiliary nozzles with the ring vibrator and the main jet opening in phantom lines.

The fuel injection nozzle arrangement herein contemplated comprises a pear or egg-shaped housing 1 divided into a hemispherical upper housing 1*a* and a conical or frusto-conical lower housing 1*b*. The two halves 1*a* and 1*b* are bolted together by flanges. A plurality of auxiliary nozzles used for the injection of various fuels and oxidizers are disposed in holders 6 which are set symmetrically about the longitudinal axis of the upper housing 1*a* so as to focus on the center of a disc-shaped ultrasonic vibrator 8 which stretches across the junction of the upper and lower housing so as to form a hemispherical atomizing chamber 2. This disc-shaped ultrasonic vibrator 8 is supported by holders 7, 7′ which are centripetal projections from the flanges of the upper and lower housing 1*a* and 1*b*. Cuts are provided at the edges of holders 7 so that the vibrator disc 8 is suspended by packing 10 made of chemically stable elastic material such as synthetic rubber. The diameter of the disc-shaped vibrator 8 has to be smaller than the inner diameter of the housing in order to provide an adequate flow of the mixture through the marginal gap or space 11 towards a main jet 3 at the apex of the conical housing 1*b*. The cross-section of the disc-shaped vibrator 8 can be flat, concave or convex, but only the flat shape is shown in the drawing. The ring-shaped ultrasonic vibrator 13 is smaller in diameter than a circular groove 12 at the apex of the conical lower housing 1*b*, suspended with elastic material 15 and kept in place with a threaded stopper 14. The inner diameter of the opening of ring-shaped stopper 14 has to be larger than the diameter of vibrator 13 so that part of the vibrator forms the throat of the main jet nozzle 3 which has an outer threaded projection 4. Both of the ultrasonic vibrators are connected to ultrasonic vibrators have generators 17 and 17′ connected thereto by cables 16 and 16′ which run through small grooves curved in the housing 1. In FIG. 4 another version of the inventive concept is shown. Only two auxiliary nozzles are used and the main nozzle housing has a shape much easier to manufacture. In cases where the auxiliary nozzles 5*a*, 5*b*, 5*c* are used for air injection only and the device is operated in a manner similar to supercharging, the disc-shaped vibrator may be eliminated as shown in FIG. 6 since atomizing is sufficient without using a disc vibrator.

OPERATION OF THE INVENTION

The fuel injection nozzle arrangement has a threaded extension on the main jet nozzle so that the whole assembly can be coupled into an intake manifold, precombustion chamber, main-combustion chamber etc. of an engine at any desired angle.

One of the auxiliary nozzles 5*a* is used for the injection of a base fuel such as gasoline, kerosene, diesel fuel, heavy oil, LPG, LNG and CNG. The other nozzle 5*b* is connected to a hydrogen supply. Another nozzle 5*c* is connected to a reservoir with water or solution of which the main component is water. If it is so desired, additional holders and fuel injectors may be installed on the upper housing 1*a* in a manner similar to the other auxiliary nozzles and their holders, and the additional injectors are used for the injection of additional fuel such as methyl-alcohol or ethyl-alcohol, or appropriate oxidizers such as pure oxygen. A small computer controls the operation of the auxiliary nozzles 5*a*, 5*b*, 5*c* and the additional nozzles, as well as the ultrasonic generators 17 and 17'. The computer determines the amount of each type of fuel, oxidizers and water ejected from the nozzles and thus determines the composition of the mixture of fuels, oxidizers and water, referred to herein as a mixture. The vibration frequencies of the vibrators 8 and 13 are also altered in accordance with the composition of the mixture for best atomizing efficiency. When a heat engine is turned on, vibrators, generators and nozzles start to work simultaneously. Fuels and oxidizers are ejected into the atomization chamber 2 as a mist and aimed at the center of the disc vibrator 8. Thus mixed and atomized thoroughly, the mist and the vapor of the mixture flow down through the space 11 after being deflected on the inside wall of the housing 1*a*. Some droplets coagulate on the inner surface of housing 1, drip down towards the main jet 3, reatomized with ring vibrator 13, emerge with the main stream of atomized mixture and accelerate through the main jet.

The present invention provides thorough mixing and complete atomization of several kinds of fuel, oxidizers and water in a very short time. Another unique feature of the present invention is that the composition of the mixture can be altered as desired.

FIG. 6 shows the effect of the addition of hydrogen into gasoline (*Road and Track*, 3, 1974). It is shown that the addition of small amounts of hydrogen into gasoline significantly extends the lean flamability limit of gasoline, allowing much leaner fuel-air mixtures without misfire and, as it is shown, keeps the emission of oxides of nitrogen substantially below what is possible with gasoline. One of the difficulties of using hydrogen as a fuel is its ignition energy, 0.02 joules compared to 0.2 to 0.4 joules for gasoline. In a conventional reciprocating engine this causes a combustion knock. This is controlled by water injection with the present arrangement. Another difficulty is the storage of a hydrogen source. It is believed that the most practical solution for this problem with today's technology is a partial oxidation steam reforming process of hydrocarbon material. For this purpose, the present invention is very useful as an atomizer which is essential in the process. A further difficulty of using hydrogen as a fuel in internal-combustion engines is that hydrogen generally gives better thermal efficiency but lower power output than with gasoline. The present invention enables the instantaneous alternations of mixing ratios of the fuels so that the composition of the mixture fed into an engine is always best suited for the required engine tasks. For example, in a conventional auto engine, the proportion of gasoline in the mixture is increased under heavy load whereas the proportion of hydrogen is increased when the engine is idling.

Another unique feature of the present invention is that it enables the use of a wide range of materials as a fuel for an engine. The capability of making non-fossil fuel such as ethyl-alcohol and methyl-alcohol without bringing major modifications in present engines could be a critical advantage of the present invention in the near future. Recently a U.S. Army research laboratory reported the economical method of producing ethyl-alcohol from cellulose waste. The difficulties of applying ethyl-alcohol as a fuel for an engine are similar to the ones of hydrogen.

The features of the present invention are carried out by using already established technologies such as electronically controlled fuel injection nozzles, water injection and ultrasonic atomization. Therefore, the manufacture of the present arrangement is both simple and relatively inexpensive.

We claim:

1. A fuel injection nozzle assembly comprising in combination:

a. a housing with an inner wall of symmetrical curvilinear cross-sectional configuration around a longitudinal central axis, a mid-section defined in said housing, one end of said housing being tapered from about said mid-section towards said one end (1*b*);

b. retaining means (7, 7') coupled to said inner wall at said mid-section and a central ultrasonic vibrating disc (8, 8') retained by said retaining means, said disc having a diameter less than that of said housing leaving a gap (11) between said inner wall and said disc outer periphery;

c. a main ultrasonic nozzle (3') including a ring vibrator (13, 13') at said tapered end (1*b*) including a threaded outwardly projecting coupling side for coupling to a fuel combustion zone; and, d. at least first and second auxiliary jet nozzles at said housing other end (1*a*) generally projecting angularly towards the intersection of said disc (8, 8') and said central axis.

2. An assembly as claimed in claim 1, the housing inner wall having a pear-shaped configuration, the tapered one end (1*b*) being frusto-conical, the other end being substantially hemisphere shape.

3. An assembly as claimed in claim 2 including defined auxiliary nozzle holders (6) holding said auxiliary nozzles (5*a*, 5*b*) therein.

4. An assembly as claimed in claim 3, said housing being in two sections and held together at the mid-section by the retaining means.

5. An assembly as claimed in claim 1, said housing having a mid-section with a substantially cylindrical inner wall, said tapered end being frusto-conical and said other end having outwardly projecting legs, said auxiliary nozzles being disposed therein.

6. A fuel injection nozzle assembly comprising:

a. a pear-shaped inner housing with a spherical end (1*a*) and a conical end (1*b*), a plurality of auxiliary nozzle holders (6) symmetrically disposed around the housing longitudinal axis in said spherical end (1*a*) and a main nozzle (3) including an ultrasonic ring vibrator, said main nozzle (3) having an outwardly projecting coupling extension (4) to couple the assembly to fuel combustion means;

b. a plurality of auxiliary nozzles (5*a*, 5*b* retained by said nozzle holders; and, c. a central ultrasonic vibrating disc (8) retained between said spherical and conical ends, the diameter of said disc being smaller than the diameter of said housing leaving a gap between said disc and said housing.

7. An assembly as claimed in claim 6 in which said disc-shaped ultrasonic vibrator is disposed so as to form a hemisphere with the inside wall of said housing.

8. An assembly as claimed in claim 7 in which said ring-shaped ultrasonic vibrator is disposed inside the throat of said main nozzle.

* * * * *